United States Patent [19]

Sher

[11] Patent Number: 5,054,122

[45] Date of Patent: Oct. 8, 1991

[54] STRUCTURE OF HAT WITH COOLING SYSTEM FOR THE HEAD

[76] Inventor: Cheng-Hsien Sher, No. 18, Lane 195, Nan Tai Rd., Kauhsiung City, Taiwan

[21] Appl. No.: 516,941

[22] Filed: Apr. 30, 1990

[51] Int. Cl.[5] ..... A42B 3/28

[52] U.S. Cl. ..... 2/7; 2/171; 2/181; 2/181.6; 2/182.3; 2/182.8; 2/185 R; 2/199

[58] Field of Search ..... 2/7, 171, 171.1, 171.2, 2/171.3, 181, 181.2, 181.4, 181.6, 181.8, 182.1, 182.2, 182.3, 182.4, 182.5, 182.6, 182.7, 182.8, 185 R, 199, 209.4

[56] References Cited

U.S. PATENT DOCUMENTS

| | | | |
|---|---|---|---|
| 1,503,287 | 7/1924 | Pizzutiello | 2/182.8 |
| 1,528,220 | 3/1925 | Leighton | 2/181.6 |
| 1,731,025 | 10/1929 | Rockwood | 2/182.8 |
| 2,421,633 | 6/1947 | Lyon | 2/7 |
| 2,445,209 | 7/1948 | Clark | 2/181 |
| 2,580,323 | 12/1951 | Russell | 2/182.8 |
| 2,832,077 | 4/1958 | McGinnis | 2/7 |
| 3,029,438 | 4/1962 | Henschel | 2/7 |
| 3,070,803 | 1/1963 | Slepicka | 2/7 |
| 4,130,902 | 12/1978 | Mackenroth | 2/182.3 |
| 4,484,363 | 11/1984 | Varanese | 2/181 |
| 4,742,581 | 5/1988 | Rosenthal | 2/171 |
| 4,776,042 | 10/1988 | Hanson | 2/7 |
| 4,815,144 | 3/1989 | Martin | 2/7 |
| 4,918,758 | 4/1990 | Rendina | 2/171 |
| 4,941,210 | 7/1990 | Konucik | 2/171 |

FOREIGN PATENT DOCUMENTS

| | | | |
|---|---|---|---|
| 295374 | 3/1954 | Switzerland | 2/182.8 |

*Primary Examiner*—Werner H. Schroeder
*Assistant Examiner*—Diana L. Biefeld
*Attorney, Agent, or Firm*—Varndell Legal Group

[57] ABSTRACT

A structure of hat with cooling system for the head, which comprises a covering for the head, having a channel holder made on its inner wall surface for the fastening therein of a plurality of cooling elements and a flexible, ventilating socket. The cooling elements absorb heat when the hat is put on the head, so as to cool and comfort the head.

4 Claims, 3 Drawing Sheets

STRUCTURE OF HAT WITH COOLING SYSTEM FOR THE HEAD

BACKGROUND OF THE INVENTION

The present invention is related to hats and more particularly to a structure of hat with cooling system for the head.

While working under the sun, people usually put a hat on one's head to protect against direct sunlight. When bearing a hat to work under direct sunlight for a certain period of time, oppressive hot air immediately fills in the space between the head and the hat to make one feel uncomfortable and depressed.

SUMMARY OF THE INVENTION

The present invention has been accomplished under the circumstances in view. It is an object of the present invention to provide a cooling hat which can efficiently cool the head.

Another object of the present invention is to provide a cooling hat which protects people from suffering a sun-stroke.

Still another object of the present invention is to provide a cooling hat which is durable in use and inexpensive to manufacture.

Still another object of the present invention is to provide a cooling hat which is easy to assemble.

Still another object of the present invention is to provide a cooling hat which provides good ventilation.

To accomplish the above objects, a cooling hat comprises a covering for the head and having a channel holder internally made on its periphery for the fastening therein of a certain pieces of cooling elements and a ventilating socket. The cooling elements absorb heat and greatly reduce surface temperature to comfort the head. The quantity of the cooling elements can be flexibly arranged according to actual requirement.

DETAILED DESCRIPTION OF THE PREFERRED EMBODIMENTS

Figure 2:
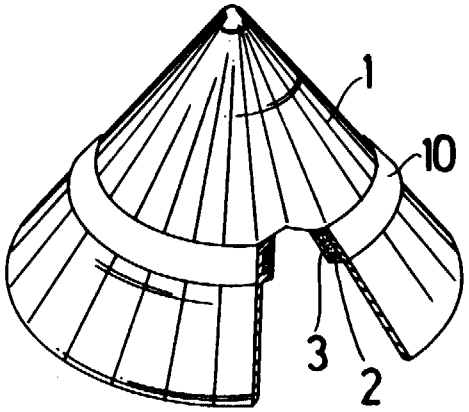
FIG. 2 is a partly sectional assembly view thereof.
Figure 3:
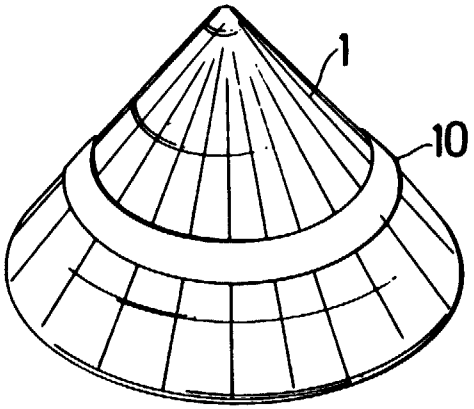
FIG. 3 is a perspective view thereof.
Figure 1:
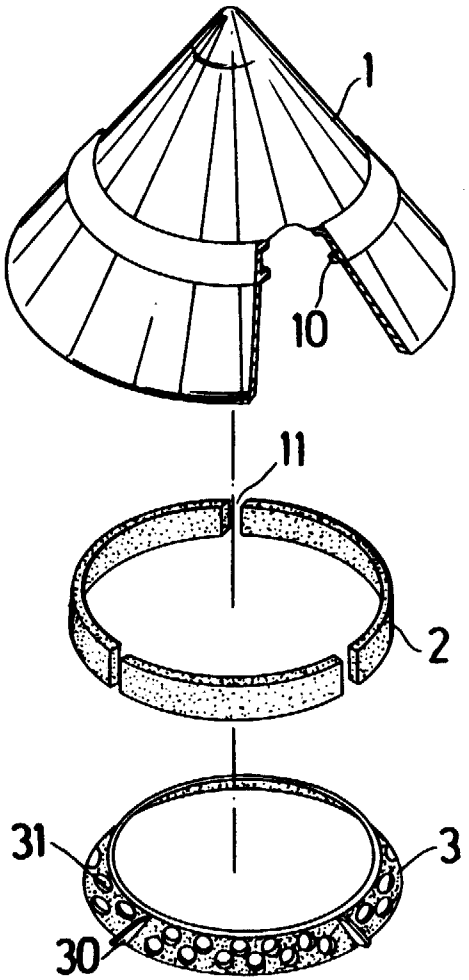
FIG. 1 is a perspective fragmentary and partly sectional view of the present invention.

Turning now to the annexed drawings in greater detail and referring first to FIGS. 1 through 3, therein illustrated is a broad-brimmed hat 1 for farmers, which is made of lightweight, sun proof material having good heat insulating and tear resisting properties. A circular channel holder 10 is made on the inner surface of the crown of the hat 1 for the fastening therein of a certain quantity of cooling elements 2. The cooling elements 2 are made of chemicals to absorb heat from the surface of an object so as to greatly reduce the surface temperature of an object. The cooling elements 2 are flexible so that they can be bent to set in the channel holder 10 easily. The width of the channel holder 10 is slightly smaller than the width of the cooling elements 2 so that the cooling elements 2 can be firmly retained once they are squeezed to set therein. After the setting of the cooling elements 2 in the channel holder 10, a ventilating socket 3 which is made of soft and conductive material is mounted on the channel holder 10 with the cooling elements 2 squeezed in therebetween. The ventilating socket 3 has three projecting strips 30 triangularly made on its periphery and respectively fastened in corresponding gaps 11 made on the channel holder 10 between the cooling elements 2. A plurality of vent holes 31 are made on the ventilating socket 3 around its periphery for ventilation.

Figure 4:
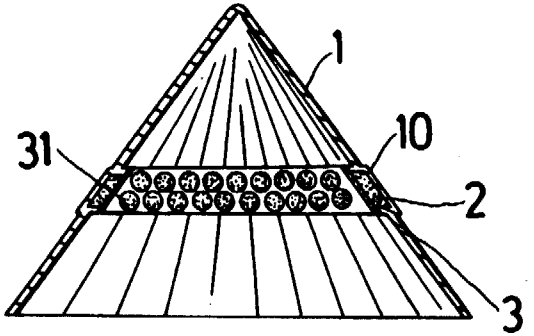
FIG. 4 is a sectional elevational view thereof.
Figure 5:
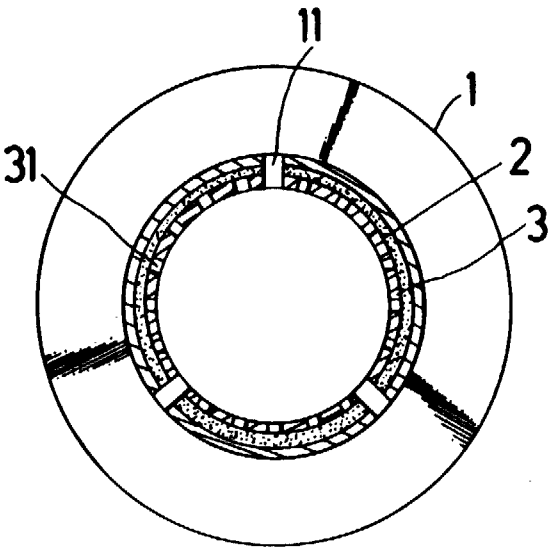
FIG. 5 is a sectional top view thereof.
Figure 6:
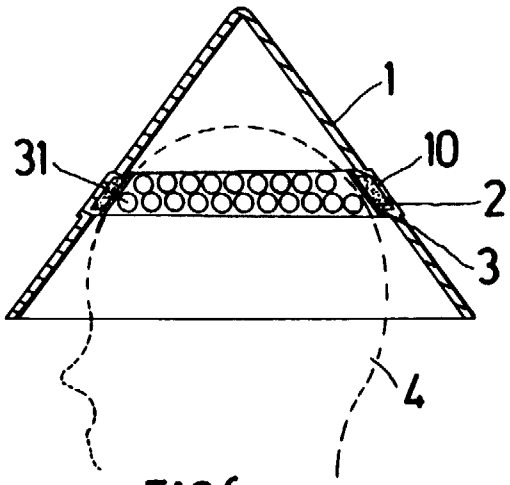
FIG. 6 is a sectional schematic drawing of the present invention when the hat is put on the head.

Referring to FIGS. 4 through 6, the channel holder 10 and the ventilating socket 3 are designed to fit the configuration of the hat 1. After the cooling elements 2 and the ventilating socket 3 are fastened in the channel holder 10, the whole assembly of the hat 1 still keeps in good shape comfortable for covering on the head. Because of the design of the gaps 10 and the vent holes 31, good ventilation is achieved inside the hat 1 when the hat is put on the head, and the cold air released from the cooling elements 2 is circulated inside the hat 1 to cool the head.

When the hat 1 is put on the head 4, as shown in FIG. 6, the ventilating socket 3 and the channel holder 10 are closely in contact with the head 4 permitting the cooling elements 2 to absorb heat and greatly reduce surface temperature so as to cool the head 4.

Figure 7:
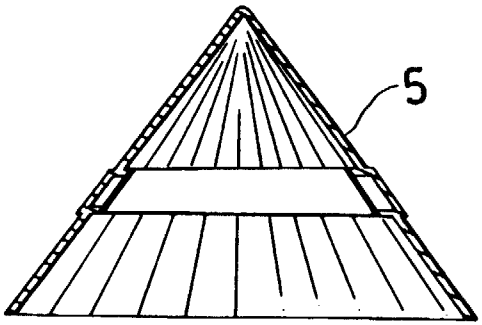
FIG. 7 is a schematic drawing of the present invention, in which the cooling element is removed from the hat.
Figure 11:
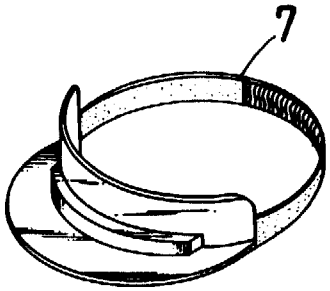
FIG. 11 illustrates still another alternate form of the present invention.
Figure 12:
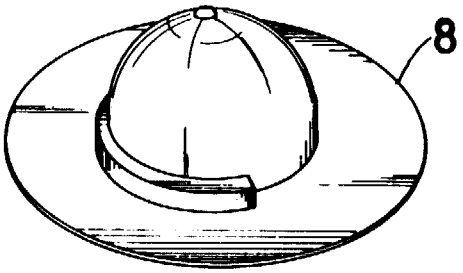
FIG. 12 illustrates a yet further alternate form of the present invention.
Figure 10:
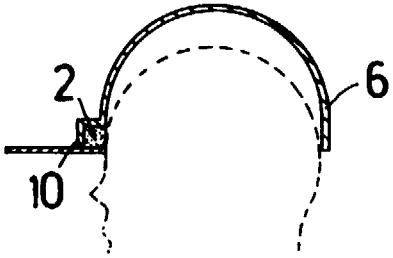
FIG. 10 illustrates the use of the embodiment of FIG. 8.
Figure 8:
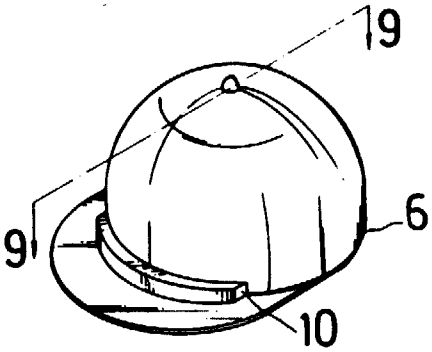
FIG. 8 illustrates an alternate form of the present invention.
Figure 9:
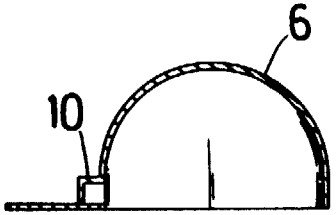
FIG. 9 is a sectional view taken on line 9—9 of FIG. 8.

Referring to FIG. 7, cooling elements 2 can be conveniently removed from or attached to a hat 5, which is constructed according to the present invention, according to temperature change or weather condition.

Referring to FIGS. 8 through 12, as an alternate form of the present invention, a channel holder 10 may be made on the front edge of a cap 6 (see FIGS. 8 through 10), a visor 7 (see FIG. 11) or a broad-brimmed hat 8 (see FIG. 12) for receiving therein a certain quantity of cooling elements 2. When a channel holder 10 is made on the front edge of a broad-brimmed hat 8, the both ends of the channel holder 10 can be bilaterally extended to the temples so that much cooling air can be released to comfortably cool the head.

As is apparent from the forgoing specification, the invention is susceptible of being embodied with various alterations and modifications which may differ particularly from those that have been described in the preceding specification and description. Recognizing various modifications been apparent the scope herein shall be deemed as defined in the claims set forth hereinafter.

I claim:

1. A hat comprising a head covering including a portion adapted to be disposed adjacent the forehead of a wearer, said portion having an inwardly opening channel on the inner surface thereof, a plurality of cooling elements disposed within said channel, said cooling elements each having opposite ends, the ends of adjacent cooling elements being spaced from one another to define gaps therebetween, a ventilating socket disposed inwardly of said cooling elements, said ventilating socket having a plurality of vent holes formed therethrough, said ventilating socket having a plurality of spaced outwardly extending strips thereon, said strips being fastened within said gaps.

2. A hat as defined in claim 1 wherein said cooling elements comprise bodies formed of chemicals adapted to absorb heat from the surface of an object.

3. A hat as defined in claim 1 wherein said channel has a predetermined width, said cooling elements being flexible and each having a width slightly larger than the width of said channel so that the cooling elements can be squeezed into place within said channel and firmly held in position.

4. A hat as defined in claim 1 wherein said ventilating socket is of annular construction and wherein said strips are disposed on at least three spaced portions of said ventilating socket.

* * * * *